US009816338B1

(12) United States Patent
Hanson et al.

(10) Patent No.: US 9,816,338 B1
(45) Date of Patent: Nov. 14, 2017

(54) ELONGATED FILTER FOR USE IN WELLBORE OPERATIONS

(71) Applicant: Iron Horse Oilfield Service Group, LLC, Deer Park, TX (US)

(72) Inventors: Erik Hanson, La Marque, TX (US); Jupertino Rosales, Jr., McAllen, TX (US)

(73) Assignee: Iron Horse Oilfield Service Group, LLC, Deer Park, TX (US)

( * ) Notice: Subject to any disclaimer, the term of this patent is extended or adjusted under 35 U.S.C. 154(b) by 0 days.

(21) Appl. No.: 15/383,928

(22) Filed: Dec. 19, 2016

Related U.S. Application Data

(60) Provisional application No. 62/334,892, filed on May 11, 2016.

(51) Int. Cl.
*E21B 27/00* (2006.01)
*E21B 43/08* (2006.01)

(52) U.S. Cl.
CPC ..... *E21B 27/005* (2013.01); *E21B 43/084* (2013.01)

(58) Field of Classification Search
CPC ..... E21B 21/01; E21B 21/06; E21B 21/063; E21B 21/065; E21B 37/00; E21B 43/08; E21B 37/08; E21B 43/084; E21B 43/082; E21B 43/088; E21B 27/005; E21B 27/02; E21B 40/00; B01D 35/02; B01D 33/0116; B01D 33/0125; B01D 29/15; B01D 35/30; B01D 29/111; B01D 29/114
USPC ..... 166/99; 210/448, 458
See application file for complete search history.

(56) References Cited

U.S. PATENT DOCUMENTS 261,253 A * 7/1882 Olmsted ..... E21B 43/084 166/230
715,676 A * 12/1902 Lindstrom ..... E21B 43/084 166/230
746,096 A * 12/1903 Karsch ..... E21B 43/084 166/157
834,431 A * 10/1906 Williams ..... B01D 35/02 210/448
1,135,809 A * 4/1915 Jones ..... E21B 43/103 166/195
2,768,751 A * 10/1956 Booth ..... B01D 29/111 210/193
4,098,698 A * 7/1978 Lamothe ..... E21B 21/12 175/206
4,106,562 A * 8/1978 Barnes ..... B01D 35/02 166/205
4,284,500 A * 8/1981 Keck ..... B01D 29/15 209/250
4,495,073 A * 1/1985 Beimgraben ..... E21B 21/002 166/227

(Continued)

*Primary Examiner* — Michael Wills, III
(74) *Attorney, Agent, or Firm* — Edmonds & Cmaidalka

(57) ABSTRACT

A filter for trapping solids and methods for using the same. The filter can include at least two support members that can be oriented in a first direction, and at least two support members that can be oriented in a second direction. The second direction can be generally orthogonal to the first direction. A housing can encase and surround the support members, and can thereby form an opening therethrough. The housing can include one or more apertures providing a flow path from within the housing to outside the housing. A first end can permit fluid flow into the housing, and a second end can at least partially restrict fluid flow therethrough.

20 Claims, 7 Drawing Sheets

(56) References Cited

U.S. PATENT DOCUMENTS

| | | | | |
|---|---|---|---|---|
| 6,598,685 | B1 * | 7/2003 | Mashburn | E21B 21/002 166/227 |
| 6,668,920 | B2 * | 12/2003 | Setterberg, Jr. | B01D 29/111 166/228 |
| 7,165,633 | B2 * | 1/2007 | Hall | E21B 21/002 166/228 |
| 7,549,486 | B2 * | 6/2009 | Mashburn | E21B 21/002 166/236 |
| 7,980,330 | B1 * | 7/2011 | LeJeune | E21B 21/01 166/227 |
| 8,028,768 | B2 * | 10/2011 | Hall | E21B 21/00 166/205 |
| 9,095,799 | B1 * | 8/2015 | Packard | B01D 35/023 |
| 2006/0070735 | A1 * | 4/2006 | Guerra | E21B 43/34 166/267 |
| 2013/0048551 | A1 * | 2/2013 | Maxson | B01D 35/02 210/323.2 |
| 2016/0326849 | A1 * | 11/2016 | Bruce | E21B 43/08 |

* cited by examiner

ELONGATED FILTER FOR USE IN WELLBORE OPERATIONS

BACKGROUND

Field

Embodiments provided herein generally relate to hydrocarbon production. More particularly, such embodiments relate to filtration of solid particulates from well fluids.

Description of the Related Art

Well operations, such as milling out a tool or pipe from a wellbore or hydraulic fracturing ("fracking") operation, create solid particulates or debris that needs to be collected and removed from the well. Particulate or debris collection tools are sometimes referred to as junk baskets, collector baskets, or sand screens. There are a variety of different collection tools that operate on different principles. However, in general, these various tools have a common objective of separating circulating fluid from the cuttings and/or other particulates or debris present in the wellbore.

Conventional filters used to separate solid particulates from the liquid stream include accordion-style, pleated polymeric filters, made of a cloth-like material. Fluid flows in through the outer diameter of the filter, and flows out through the inner diameter. The required outer diameter to inner diameter flow contributes to plugging of the annulus between the filter and the cylindrical housing in which the filter is positioned. After a relatively short time, generally about 3 hours during fracking operations, the filter becomes clogged. It must then be removed, disposed of, and replaced with a new filter.

There is a need, therefore, for a robust filter design that can withstand conditions, decrease annulus plugging, and decrease costs associated with multiple replacement filters for a wellbore or workover operation.

SUMMARY

A filter for trapping solids, a method for filtering particulates from well fluids, and a method for retrieving wellbore fluids using the same are provided herein. In at least one embodiment, the filter can include at least two support members that can be oriented in a first direction, and at least two support members that can be oriented in a second direction. The second direction can be generally orthogonal to the first direction. A housing can encase and surround the support members, and can thereby form an opening therethrough. The housing can include one or more apertures providing a flow path from within the housing to outside the housing. A first end can permit fluid flow into the housing, and a second end can at least partially restrict fluid flow therethrough.

In at least one specific embodiment, the method for filtering particulates from well fluids can include flowing a fluid comprising a mixture of liquids and solids into a filter. The filter can include at least two support members that can be oriented in a first direction, and at least two support members that can be oriented in a second direction. The second direction can be generally orthogonal to the first direction. A housing can encase and surround the support members, and can thereby form an opening therethrough. The housing can include one or more apertures providing a flow path from within the housing to outside the housing. A first end can permit fluid flow into the housing, and a second end can at least partially restrict fluid flow therethrough. At least a portion of solids within the fluid can be captured by the filter and retained within an inner surface of the filter. At least a portion of solids within the fluid can be captured by the filter and retained within an inner surface of the filter.

In at least one specific embodiment, the method for retrieving wellbore fluids can include capturing solid particulates entrained in a fluid stream into an inner surface of a filter. The filter can include at least two support members that can be oriented in a first direction, and at least two support members that can be oriented in a second direction. The second direction can be generally orthogonal to the first direction. A housing can encase and surround the support members, and can thereby form an opening therethrough. The housing can include one or more apertures providing a flow path from within the housing to outside the housing. A first end can permit fluid flow into the housing, and a second end can at least partially restrict fluid flow therethrough. The method can further include directing the fluid stream into an inner diameter of the filter, exiting the fluid stream through an outer diameter of the filter, and separating saleable gas and liquid from disposable liquid.

BRIEF DESCRIPTION OF THE DRAWINGS

Non-limiting, illustrative embodiments are depicted in the drawings, which are briefly described below. It is to be noted, however, that these illustrative drawings illustrate only typical embodiments and are not to be considered limiting of its scope, for the invention can admit to other equally effective embodiments.

DETAILED DESCRIPTION

Figure 1:
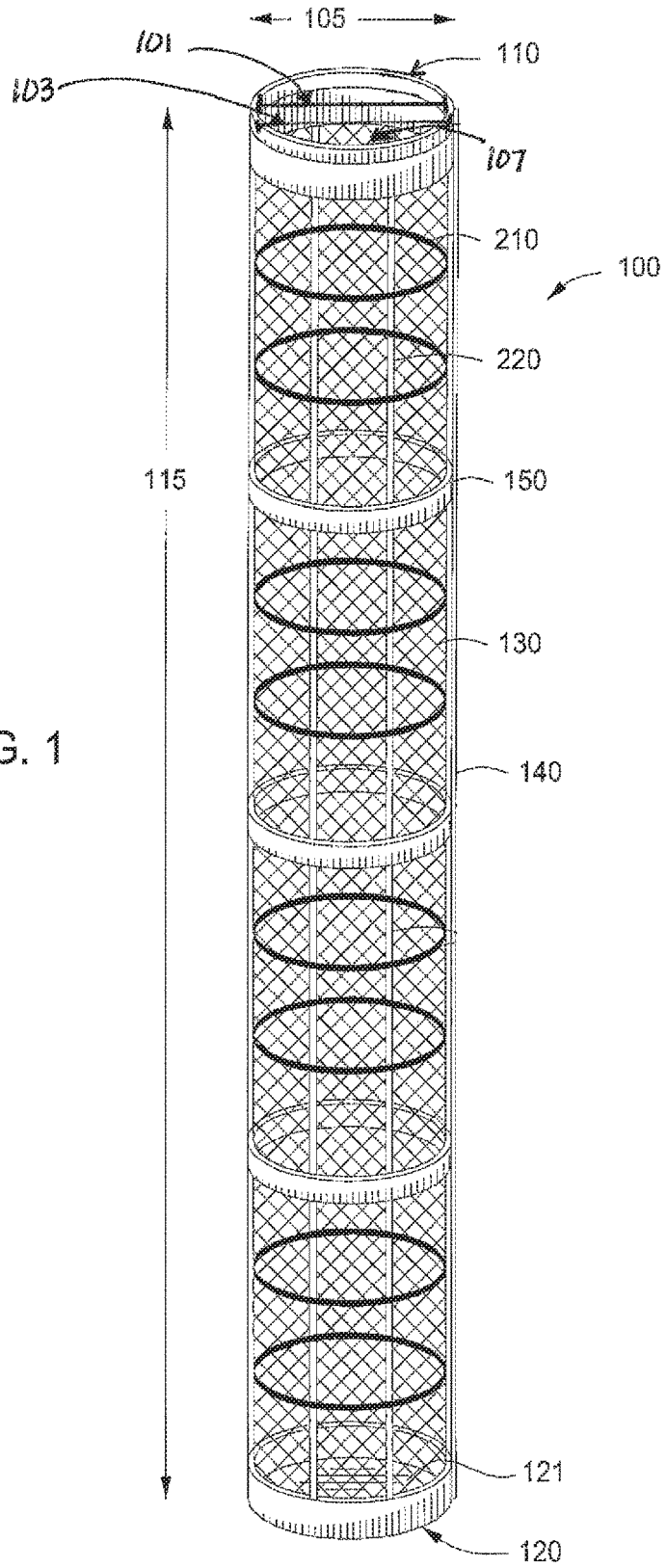
FIG. 1 depicts a side elevation view of an illustrative filter, according to one or more embodiments described herein.

FIG. 1 depicts a side elevation view of an illustrative filter 100, according to one or more embodiments described. The filter 100 can have an inner diameter 101, an outer diameter 103, and a length (L). The filter 100 further includes at least two support members 210 that are oriented in a first direction 210 that are generally parallel to a lateral side or axis 105 of the filter 100 ("lateral supports 210"). The filter 100 further includes at least two support members 220 that are oriented in a second direction that are generally parallel to a longitudinal side or axis 115 of the filter 100 ("longitudinal supports 220").

A housing 130 can be placed about or around the outer diameter 103 of the filter 100 to surround the longitudinal supports 220 and the lateral supports 210, providing a bore or flow path through the filter 100. The housing 130 can be a mesh screen or other apertured surrounding.

A first end 110 of the filter 100 can be open or unobstructed to a fluid flowing into the inner diameter 101 of the filter 100. A sealing material, such as an elastomeric O-ring (not shown), can be disposed about the first end 110 of the filter 100 to provide a connective seal between a surrounding piping (not shown) or other housing or other attachments necessary for directing fluids into the inner diameter 101 of the filter 100.

A second end 120 of the filter 100 can have a cap 121 that at least partially restricts the fluid from exiting the second end 120 of the filter 100. The cap 121 can be fabricated from the same material as the housing 130. The cap 121 can be solid to prevent the any fluid flow through the second end 120 of the filter 100. To at least partially restrict the flow of fluid through the second end 120 of the filter 100, the cap 121 can have one or more holes, openings, or apertures. The size of each opening can be the same or can vary. In some embodiments, the size of the cap opening can be the same as those on the housing 130 or each can vary. Suitable opening sizes, for example, can range from a low of 300, 400, or 500 microns to a high of 600, 800, or 1000 microns.

The lateral supports 210 are preferably spaced apart from one another, i.e. not touching one another. The lateral supports 210 can be concentric, parallel, offset, or angled. The cross-sectional shape of the lateral supports 210 can vary, including, but not limited to, circular, square, rectangular, triangular, oval, or any other circular or polygonal shape as desired.

The total number of lateral supports 210 can vary, depending on the desired strength and overall length and width of the filter 100. For example, the number of lateral supports 210 can range from a low of about 2, 3, 5, 8, or 10 to a high of about 15, 20, or 25. The distance between the lateral supports 210 can be equidistant or can vary across the length of the filter 100. For example, the distance between the lateral supports 210 can range from a low of about 6 inches, 8 inches, or 10 inches to a high of about 12 inches, 14 inches, or 18 inches.

The longitudinal supports 220 can be located generally parallel to the longitudinal axis 115 of the filter 100, although one or more longitudinal supports 220 can be angled to provide a tapered or sloped outer diameter. The cross-sectional shape of the longitudinal supports 220 can be circular, rectangular, rectangular with rounded edges, triangular, triangular with rounded edges, square, square with rounded edges, or other cross-sectional shapes, depending upon requirements.

The length of the longitudinal supports 220 can vary, depending on the desired strength and overall length and width of the filter 100. For example, the length can range from a low of about 12, 24, 36, 55 inches, 57 inches, or 59 inches to a high of about 61 inches, 63 inches, 65 inches, 90 inches, 120 inches, or more. Similarly, the total number of longitudinal supports 220 can vary depending on the desired strength of the filter 100. For example, the total number of longitudinal supports 220 can range from about 2 to about 20, about 3 to 15, or about 4 to 6.

Both the lateral supports 210 and the longitudinal supports 220 can be fabricated from any suitable material that is compatible for its intended service. For example, the lateral and longitudinal supports 210, 220 can be fabricated from one or more metallic materials, such as stainless steel, steel, aluminum, copper, nickel, cast iron, galvanized metals or non-galvanized metals, or any alloys or mixtures thereof.

The housing 130 can be a mesh screen, or a monolithic body with a plurality of apertures formed therethrough. The housing 130 can have varying dimensions. For example, the length of the housing 130 can range from a low of about 12, 24, 36, 55 inches, 57 inches, or 59 inches to a high of about 61 inches, 63 inches, 65 inches, 90 inches, 120 inches, or more. The size of each opening formed in the housing 130 can vary, and can range from a low of 300, 400, or 500 to a high of 600, 800, or 1000 microns.

The housing 130 can be fabricated from one or more metallic materials, such as stainless steel, steel, aluminum, copper, nickel, cast iron, galvanized or non-galvanized metals, or any alloys or mixtures thereof. The housing 130 also can be fabricated from plastics, such as polyethylene, polypropylene, polystyrene, polyurethane, polyethylethyketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer, polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers, and acrylonitrile-butadiene-styrene (ABS)), polymethacrylate resins (such as polymethyl methacrylate and polyethylacrylate), cellulose resins (such as cellulose acetate and cellulose acetate butyrate), polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like), as well as mixtures, blends, and copolymers of any and all of the foregoing materials. Although the housing 130 is not shown as being pleated or corrugated, it can be. It can also be fabricated from paper or cloth-like materials.

The filter 100 can have a circular shape, as depicted in FIG. 1. The filter 100 also can have any other shape, including elliptical, oval, square, rectangular, triangular, or any other polygonal or rounded shape, depending on the desired specifications.

The overall dimensions of the filter 100 can vary, depending on the service and type of operation the filter is used. The filter 100 can have a length that ranges from a low of about 12, 24, 36, 55 inches, 57 inches, or 59 inches to a high of about 61 inches, 63 inches, 65 inches, 90 inches, 120 inches, or more. The outer diameter 103 of the filter 100 can range from a low of about 4 inches, 5 inches, or 6 inches to a high of about 8 inches, 10 inches, or 12 inches. The inner diameter 101 of the filter 100 can range from a low of about 4 inches, 5 inches, or 6 inches to a high of about 8 inches, 10 inches, or 11 inches.

The lateral supports 210 can be welded, pinned, riveted, bolted, or otherwise secured between the longitudinal supports 220. The lateral supports 210 also can be welded, pinned, riveted, bolted, or otherwise secured around the longitudinal supports 220. The end cap 121 can be welded, pinned, riveted, bolted, or otherwise secured to one of the ends of the filter 100, thereby forming a first end 110 that is open, and a second end 120 having a cap 121.

The housing 130 can be attached around the supports 210, 220 by a longitudinal seam weld 140. The housing 130 can be further secured to the supports 210, 220 by two or more clamp closures 150 that can be spaced apart and disposed around the housing 130, and positioned from the first end 110 to the second end 120. The housing 130 can also be secured around the supports 210, 220 by one or more band closures or the like (not shown). Suitable band closures include a flattened strip of material that encircle and hold objects together.

Any of the aforementioned components of the filter 100, including lateral supports 210, longitudinal supports 220, end cap 121, housing 130, clamp closures 150, etc., can be formed or made from any one or more metallic materials (such as stainless steel, steel, aluminum, brass, copper, nickel, cast iron, galvanized metals or non-galvanized metals, etc., alloys or mixtures thereof), fiberglass, composite materials (such as ceramics, wood/polymer blends, cloth/polymer blends, etc.), and plastics (such as polyethylene, polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like)), as well as mixtures, blends, and copolymers of any and all of the foregoing materials.

The filter 100 can be used to remove cuttings, clippings, debris or other solids from a hydrocarbon production process. However, the filter 100 can also be used in any other operation to separate solids from a fluid, whether a liquid or a gas.

Figure 2:
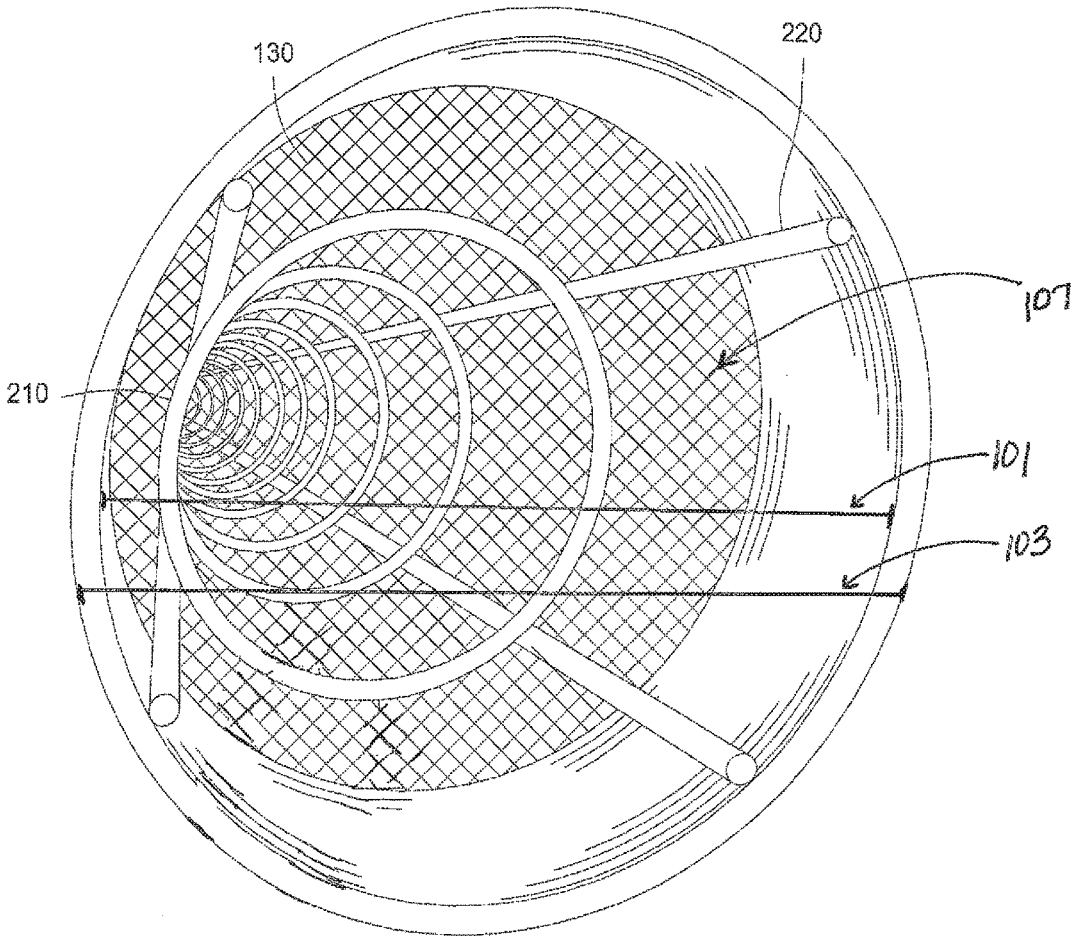
FIG. 2 depicts a perspective plan view of a first end of the filter of FIG. 1, according to one or more embodiments described herein.

FIG. 2 depicts a perspective plan view of a first end of the filter 100, according to one or more embodiments described. The first end 110 can be the open end. As shown in FIG. 2, the lateral supports 210 can be concentric and equidistant apart and generally parallel to the lateral axis 105 of the filter 100. The filter 100 can have at least four longitudinal supports 220 that are equidistant apart and generally parallel to the longitudinal axis 115 of the filter 100.

Figure 3:
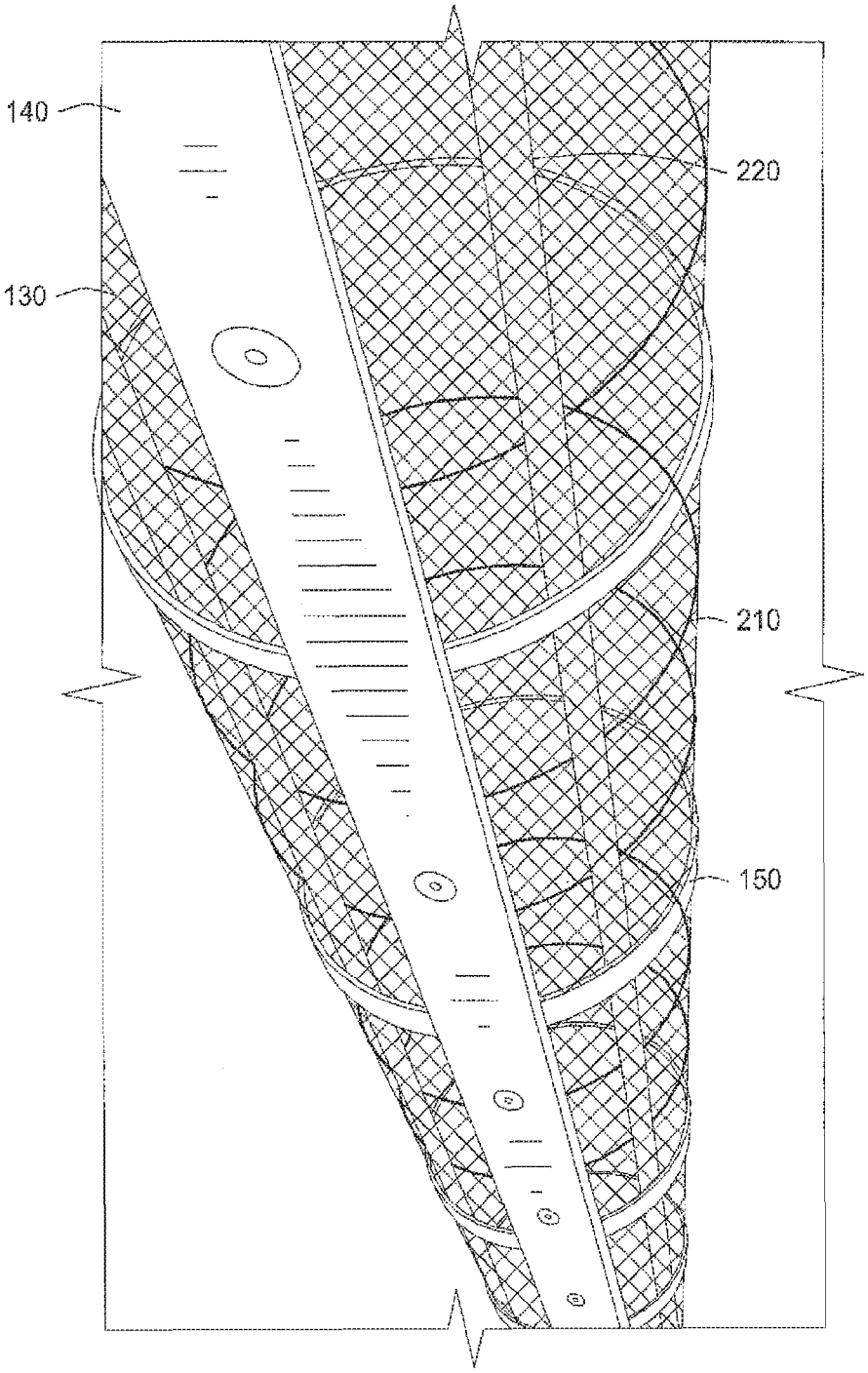
FIG. 3 depicts a partial, enlarged side view of the filter of FIG. 1, according to one or more embodiments described herein.

FIG. 3 depicts a partial, enlarged side view of the filter 100, according to one or more embodiments. The length of the longitudinal seam weld 140 can vary, as it can be approximately equivalent to the length of the filter 100. For example, the length of the longitudinal seam weld 140 can range from a low of about 12 inches, 55 inches, 57 inches, or 59 inches to a high of about 61 inches, 63 inches, 65 inches or 120 inches. The distance between the clamp closures 150 can vary depending upon the desired dimensions of the filter 100. The distance between the clamp closures 150 can be equidistant or varying distance, ranging from a low of about 6 inches, 8 inches, or 10 inches, to a high of about 12 inches, 14 inches, or 16 inches.

The longitudinal seam weld 140 and the clamp closures 150 can provide additional structural support for the filter 100. As depicted in FIG. 3, the lateral supports 210 and the longitudinal supports 220 can provide internal support, whereas the longitudinal seam weld 140 and the clamp closures 150 can provide external support for the filter 100. Hence, unlike other filters used for similar purposes, the structural integrity of the filter 100 can allow it to be removed from service after filled capacity has been reached, cleaned, and placed back in service for reuse.

Figure 4:
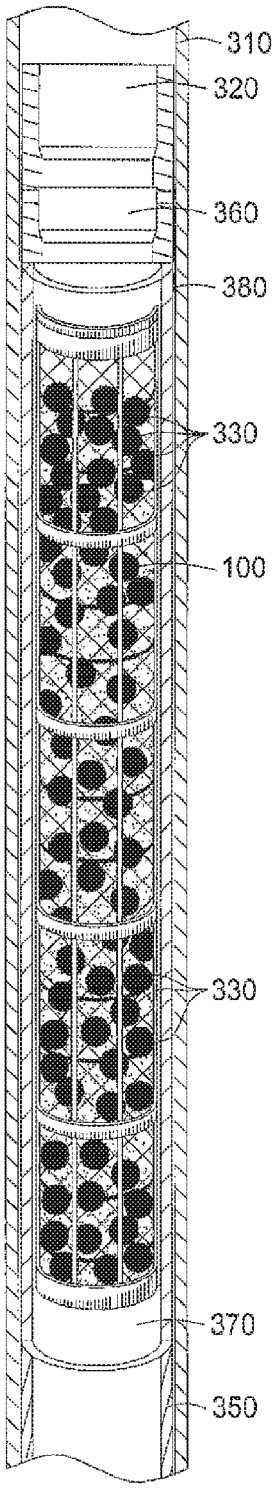
FIG. 4 depicts a partial cross-sectional view of the filter of FIG. 1, when positioned inside a housing, according to one or more embodiments described herein.

FIG. 4 depicts a partial cross-sectional view of the filter of FIG. 1, when positioned inside a housing, according to one or more embodiments described herein. Once placed in service, hydrocarbons, drilling muds, cement or other well fluids containing solid particulates 330 can be directed into a top sub 320, flow into an inner pipe 360, and subsequently directed into the inner diameter 101 of the filter 100. Fluid flow can continue through the outer diameter 103 of the filter 100, where at least some solid particulates 330 can be captured inside an inner surface 107 of the filter 100. The process of directing the fluid flow from the inner diameter 101 to the outer diameter 103 of the filter 100 can result in the annulus 370, the area between the second end 120 of the filter 100 and the container 380, being substantially free from solid particulates 330, and subsequent frequent plugging. Although the container 380 shown in FIG. 4 is cylindrical, the cross-sectional shape can vary. The container 380 can be square, rectangular, triangular, or any other shape as desired.

Figure 5:
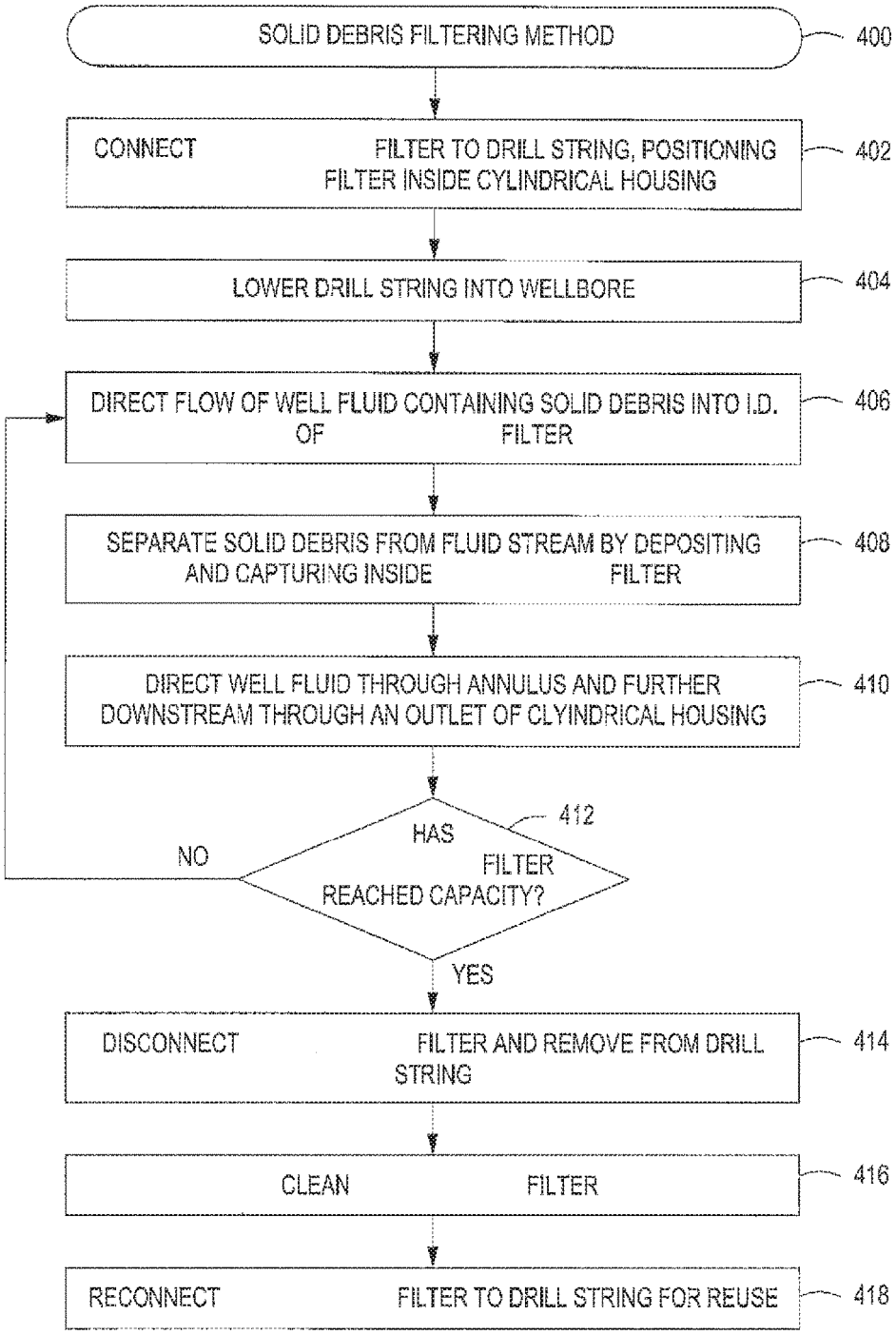
FIG. 5 depicts a flow chart of an illustrative method for filtering solid particulates from well fluids using the filter depicted in FIG. 1, according to one or more embodiments described herein.
Figure 6:
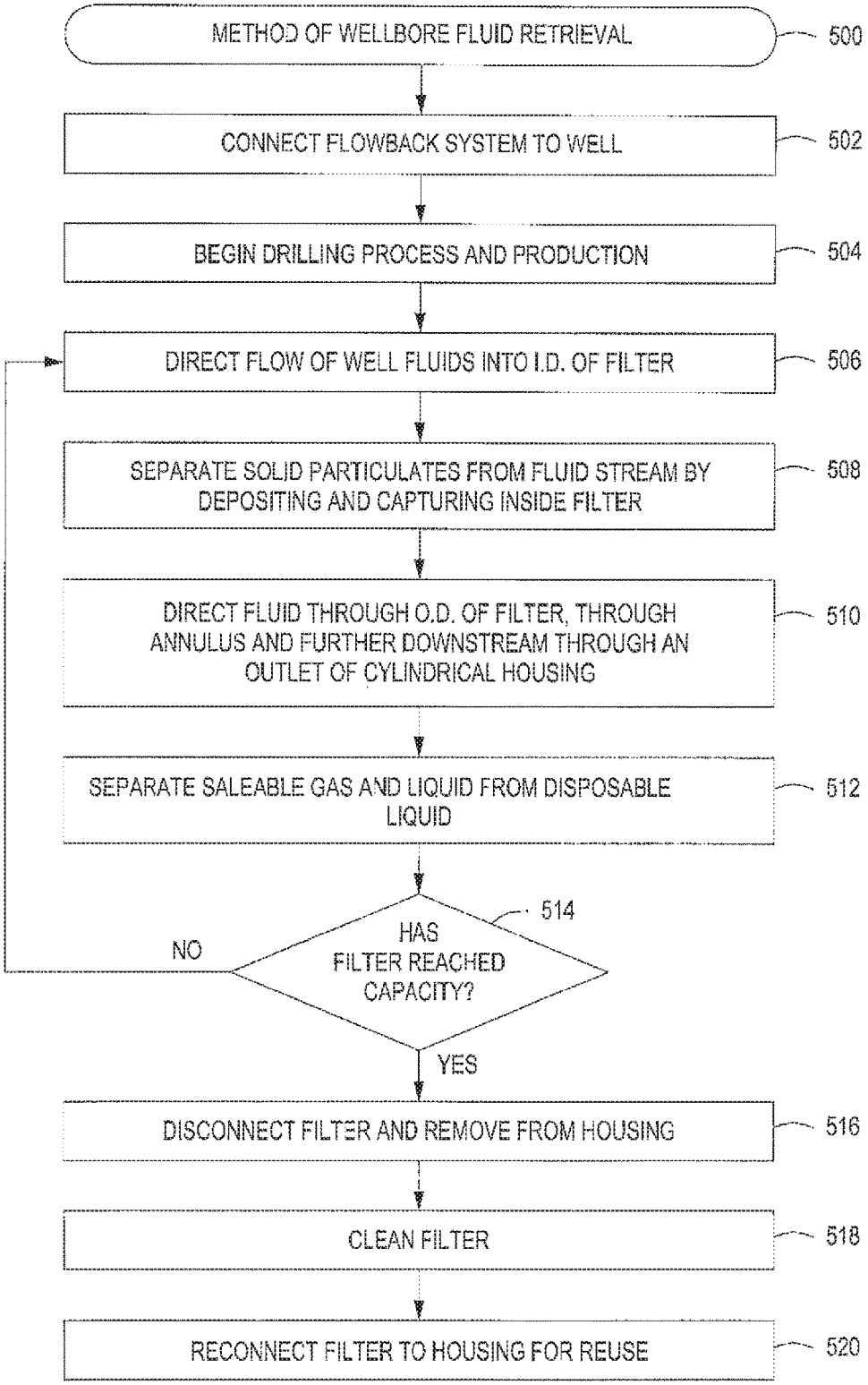
FIG. 6 depicts a flow chart of an illustrative method for filtering debris from a wellbore operation using the filter of FIG. 1, according to one or more embodiments described herein.

In use, after the filled capacity of the filter 100 has been reached, the filter 100 can be disconnected from the container 380, removed from service, and cleaned. The structural integrity of the filter 100 permits reuse after cleaning. FIGS. 5 and 6 depict illustrative methods of use.

FIG. 5 depicts a flow chart of an illustrative method for filtering solid particulates from well fluids using the filter depicted in FIG. 1, according to one or more embodiments. The filter 100 can be connected to a container or container 380, whereby the filter 100 is positioned within the container 380, 402. The container 380 can be a pipe or pipe section. The container 380 can be lowered into the wellbore 310, 404. The flow of well fluids containing a mixture of liquids and solid particulates 330 can be directed through an inlet, which can be a pipe inlet, or other fluid flow diverter, thereby directing the well fluids containing solid particulates 330 into the inner diameter 101 of the filter 100 through the first end 110, 406. Solid particulates 330 can be captured and contained inside the inner surface 107 of the filter 100, thereby, separating at least some of the solid particulates 330 from the well fluids, 408. Fluid flow can exit through the outer diameter 103 of the filter 100, at or near the second end 120, and can continue through an outlet (not shown) of the container 380, 410.

After reaching filled capacity, the filter 100 can be disconnected from the container 380 and removed 412, 414. After removal, the filter 100 can be cleaned with a pressurized or unpressurized liquid, such as water 416. Alternatively, the filter 100 can also be cleaned with pressurized air 416. After cleaning, the filter 100 can be reconnected to the container 380 and placed in service for reuse 418.

FIG. 6 depicts a flow chart of an illustrative method for filtering debris from a wellbore operation using the filter of FIG. 1, according to one or more embodiments described. More specifically, FIG. 6 depicts a flowback method following a hydraulic fracturing operation. Flowback is a water based solution that flows to the surface during and after the completion of hydraulic fracturing. After a surface mounted flowback system has been connected to the well 502, the drilling process and production can begin 504. The flow of well fluids, with entrained solid particulates 330, can be directed into the inner diameter 101 of the filter 100, 506. At least some of the solid particulates 330 can be captured or deposited inside the filter 100 and separated from the fluid stream 508.

The fluid stream can be directed through the outer diameter 103 of the filter 100, through the annulus 370, and further through an outlet of the container 380, 510. Saleable gas and liquid can be separated from the disposable liquid stream 512. The saleable gas and liquid can be sent to sales lines. After the filter 100 has reached its filled capacity, the filter 100 can be disconnected and removed from the container 380, 516. The filter 100 can be emptied of its contents, and cleaned, according to any of the aforementioned methods 518. After the filter 100 has been cleaned, it can be reconnected to the container 380 for reuse, and placed back in service 520.

Figure 7:
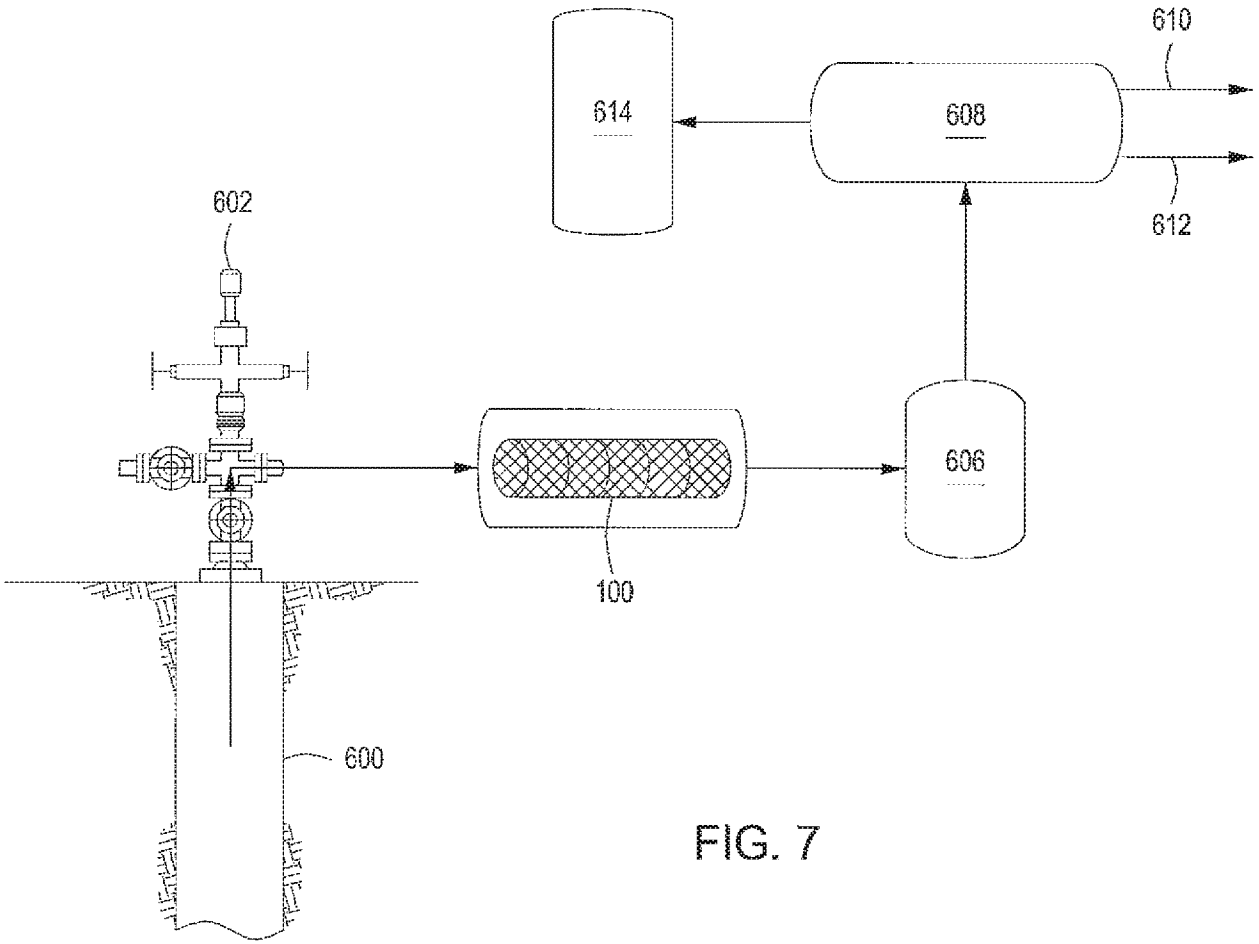
FIG. 7 depicts a process flow diagram of an illustrative system in accordance with one or more embodiments described herein.

FIG. 7 depicts a process flow diagram of an illustrative system in accordance with one or more embodiments. In a typical hydrocarbon wellbore, a Christmas tree 602 can be used to control the flow of commingled effluent out of the well 600. A line from the Christmas tree 602 can be connected to the filter 100 that is situated within a surrounding container or housing 705. As the commingled effluent passes through the filter 100, at least some of the solid particulates 330 entrained therein can be deposited inside the filter 100, allowing filtered effluent to exit through the filter 100. The term "commingled effluent" refers to any fluid stream, such as a well effluent, that includes solid particulates 330, liquids, and gas. The term "filtered effluent" refers to the fluid stream after it has passed through the filter 100, when at least some of the solid particulates 330 have been deposited inside.

The filtered effluent can flow from the filter 100 to a sand separator 606. The sand separator 606 can separate the liquids and gases from most of the remaining solids in the filtered effluent stream. Filtered effluent can pass from the sand separator 606 to a 3-phase production separator 608, where saleable gas and liquids 610, 612 can be separated out, and disposable liquids can be sent to the disposal tank 614. When the filter 100 is full or loses its efficiency, it can be removed from the container 705, cleaned and re-installed for additional use, as explained above with reference to FIG. 6.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention. And other and further embodiments of the invention can be devised without departing from the basic scope thereof, and the scope thereof is determined by the claims that follow.

What is claimed is:

1. A filter for trapping solids from wellbore fluids, comprising: at least two support members that are oriented in a first direction; at least two support members that are oriented in a second direction, the second direction being generally orthogonal to the first direction; a housing that encases and surrounds the support members, forming an opening therethrough, wherein the housing includes one or more apertures providing a flow path from within the housing to outside the housing; a first end that permits fluid flow into the housing; and a second end that at least partially restricts fluid flow therethrough.

2. The filter of claim 1, wherein the at least two support members that are oriented in the second direction are generally parallel to a longitudinal axis of the filter.

3. The filter of claim 1, wherein the housing is a mesh screen.

4. The filter of claim 1, wherein the housing is a monolithic body with a plurality of apertures formed therethrough.

5. The filter of claim 1, wherein the housing is secured around the longitudinal supports and the lateral supports by a longitudinal seam weld.

6. The filter of claim 5, wherein the longitudinal seam weld has a length ranging from about 12 inches to about 120 inches.

7. The filter of claim 5, wherein the housing is further secured to the longitudinal supports and the lateral supports by two or more closures, wherein the two or more closures can be positioned from the first end to the second end of the filter.

8. The filter of claim 7, wherein the two or more closures are clamp closures.

9. The filter of claim 1, wherein the housing has a length ranging from about 12 inches to about 120 inches.

10. The filter of claim 9, wherein the housing has a length ranging from about 55 inches to about 65 inches.

11. The filter of claim 1, wherein the housing has an outer diameter ranging from about 4 inches to about 12 inches.

12. The filter of claim 11, wherein the outer diameter ranges from about 5 inches to about 10 inches.

13. The filter of claim 1, wherein the filter is made from stainless steel, aluminum, brass, copper, nickel, cast iron, galvanized, non-galvanized metals, or any combination or mixtures thereof.

14. The filter of claim 1, wherein the second end comprises a cap having a plurality of apertures formed therethrough.

15. The filter of claim 14, wherein the plurality of apertures in the have sizes ranging from 300 microns to 1000 microns.

16. A method for filtering particulates from wellbore fluids, comprising: flowing a fluid comprising a mixture of liquids and solids into a filter, the filter comprising: at least two support members that are oriented in a first direction; at least two support members that are oriented in a second direction, the second direction being generally orthogonal to the first direction; a housing that encases and surrounds the support members, forming an opening therethrough, wherein the housing includes one or more apertures providing a flow path from within the housing to outside the housing; a first end that permits fluid flow into the housing; and a second end that at least partially restricts fluid flow therethrough, whereby at least a portion of solids within the fluid is captured by the filter and retained within an inner surface of the filter.

17. The method of claim 16, further comprising capturing the solids within the inner surface of the filter until a filled capacity is reached.

18. The method of claim 17, wherein the at least two support members that are oriented in the first direction are circular rods, and the at least two support members that are oriented in the second direction are vertical rods.

19. A method for retrieving wellbore fluids, comprising:

directing a wellbore fluid comprising a salable gas, salable liquid, and solid particulates into a filter, the filter comprising:

at least two support members that are oriented in a first direction;

at least two support members that are oriented in a second direction, the second direction being generally orthogonal to the first direction;

a housing that encases and surrounds the support members, forming an opening therethrough, wherein the housing includes one or more apertures providing a flow path from within the housing to outside the housing;

a first end that permits fluid flow into the housing; and a second end that at least partially restricts fluid flow therethrough, wherein the wellbore fluid is directed into the first end of the filter;

capturing at least a portion of the solid particulates within the housing of the filter; and exiting the salable gas and the salable liquid through an outer diameter of the filter.

20. The method of claim 19, further comprising:

capturing the solid particulates within the housing of the filter until a filled capacity is reached;

disconnecting the filter;

cleaning the filter; and reconnecting the filter.

* * * * *